US008112894B2

(12) United States Patent
Caswell

(10) Patent No.: US 8,112,894 B2
(45) Date of Patent: Feb. 14, 2012

(54) RETRACTABLE POCKET CLIP FOR KNIFE

(76) Inventor: Joseph Caswell, Newbury Park, CA (US)

( * ) Notice: Subject to any disclaimer, the term of this patent is extended or adjusted under 35 U.S.C. 154(b) by 0 days.

(21) Appl. No.: 11/466,340

(22) Filed: Aug. 22, 2006

(65) Prior Publication Data

US 2007/0289141 A1 Dec. 20, 2007

Related U.S. Application Data

(60) Provisional application No. 60/814,912, filed on Jun. 17, 2006.

(51) Int. Cl.
*B26B 3/06* (2006.01)

(52) U.S. Cl. ..... 30/151; 30/155; 24/3.11; 24/3.1; 224/269

(58) Field of Classification Search ..... 30/151–164; 224/268, 269, 930; 24/3.11, 3.12, 11, 11 R, 24/3.1; 7/118–120
See application file for complete search history.

(56) References Cited

U.S. PATENT DOCUMENTS

| | | | | |
|---|---|---|---|---|
| 1,720,471 | A * | 7/1929 | Fritsch | 24/11 S |
| 2,237,155 | A * | 4/1941 | Malis | 24/11 S |
| 2,583,142 | A * | 1/1952 | Frentzel | 401/106 |
| 2,896,290 | A * | 7/1959 | Salm et al. | 24/600.4 |
| 4,773,159 | A | 9/1988 | Casazza, Jr. | |
| 5,038,985 | A | 8/1991 | Chapin | |
| 5,152,626 | A * | 10/1992 | Eppler | 401/104 |
| 5,515,610 | A * | 5/1996 | Levin et al. | 30/161 |
| 6,591,504 | B2 * | 7/2003 | Onion | 30/160 |
| D487,628 | S | 3/2004 | Mathews | |
| 6,941,604 | B2 | 9/2005 | Ackeret | |
| 2002/0153395 | A1 | 10/2002 | Martinez | |
| 2003/0110595 | A1 * | 6/2003 | Collins et al. | 24/3.12 |
| 2004/0129746 | A1 | 7/2004 | Lee et al. | |
| 2006/0113985 | A1 | 6/2006 | Gist et al. | |
| 2007/0151110 | A1 * | 7/2007 | Chen | 30/155 |

* cited by examiner

*Primary Examiner* — Phong Nguyen

(57) ABSTRACT

A folding knife with a retractable clip is disclosed. The folding knife comprises at least two rigid plates housing at least one knife blade and the retractable clip. The retractable clip is slidably mounted between the two rigid plates and traverses a path between a retracted position and an extended position defined by a guide slot in a base portion of the clip. A guide pin intermediate the slot and between the plates limits the translational movement of the retractable clip such that its extension is optimal for affixing it onto clothing by means of an elongated member attached to the base portion, and its retraction within the housing space renders a smooth facing to the knife.

4 Claims, 2 Drawing Sheets

RETRACTABLE POCKET CLIP FOR KNIFE

CROSS-REFERENCE TO RELATED APPLICATIONS

This application claims the benefit of U.S. Provisional Patent Application 60/814,912, filed on Jun. 17, 2006.

STATEMENT REGARDING FEDERALLY SPONSORED RESEARCH AND DEVELOPMENT

Not Applicable.

FIELD OF THE INVENTION

This invention relates to pocket knives, and more particularly to a novel retractable pocket clip for such a knife.

DISCUSSION OF RELATED ART

Clips for retaining a pocket knife, and other objects, onto a pair of pants or a pants pocket are known in the art. Generally such clips are elongated and protrude from one side of the object. In the case of a pocket knife, such a clip is exemplified by U.S. Design Pat. No. 487,628, which protrudes from one side of the knife. While such a clip does help retain a knife onto an object such as a pants pocket, it is obtrusive in situations where the user does not wish to use such a clip. Such a clip can snag on items undesirably when not being used to retain the knife on an object. A similar type of clip, but used on a tape measure, can be found in U.S. Pat. No. 5,038,985 to Chapin. U.S. Pat. No. 4,773,159 to Casazza, Jr., on Sep. 27, 1988 teaches a pair of similar clips. All of these types of clips are non-retractable and, as such, tend to snag on items unintentionally.

To overcome the aforementioned drawbacks, retractable belt and pocket clips have been devised. For example, US Patent Application 2002/0153395 to Martinez on Oct. 24, 2002, teaches a retractable belt clip that pivots away from the knife, similar to the manner in which the knife blades of such a device pivot. U.S. Pat. No. 6,941,604 to Ackeret on Sep. 13, 2005 teaches a similar pivotable clip. One considerable drawback of such pivoting clips is that the space between the clip and the knife necessarily decreases in depth when moving towards the pivot point of such a clip. This tends to catch material in a scissors-type grip and can even sometimes damage such material, particularly fabric material such as pant or shirt pockets. Further, such clips do not tend to retain the knife well to objects when the objects are mobile, since such clips necessarily bind the object towards their pivot points and specifically not at their distal ends. As a result, the object is pinched only in a small area, and as such the knife can easily become dislodged if jolted.

US Patent Application 2004/0129746 to Lee et al. on Jul. 8, 2004, and US Patent Application 2006/0113985 to Gist et al. on Jun. 1, 2006 (FIG. 3), both teach retractable belt clips for objects, in one case a phone and in another case a hand tool. Such clips overcome the disadvantages heretofore mentioned, but are not readily adapted to pocket knives due to their size and structure. It is not obvious how to incorporate such clips into a pocket knife and still maintain room for a pivoting knife blade, or other knife tools. Further, such clips appear to be manufactured out of plastic, which is an undesirably weak material for use as a pocket knife clip.

Therefore, there is a need for an inexpensive, easily used retractable pocket knife clip that is sufficiently strong to withstand the rigors experienced by pocket knives, yet still reliably hold such a knife to a belt, pants pocket, or the like. The needed device would be extendible quickly into a usable, extended position, and would just as easily be collapsed into its retracted position. Such a needed device would be of relatively small volume so as to allow room for folding knife blades and other knife tools. The present invention accomplishes these objectives.

SUMMARY OF THE INVENTION

The present device is a folding knife comprising at least two rigid plates and at least one knife blade that is pivotally attached therebetween. A retractable clip of the present invention includes a base portion slidably fixed between two of the at least two rigid plates. The base portion includes a generally rectangular guide slot formed therethrough, and the knife includes a guide pin fixed between the two rigid plates of the knife and traversing the guide slot of the base portion. The retractable clip further includes an elongated clip member.

In use, when in a retracted position, the retractable clip is substantially contained between the two rigid plates of the knife. Alternately, in an extended position, the clip member of the retractable clip laterally extends outwardly away from between the two rigid plates of the knife, the guide slot and guide pin cooperating to prevent further extension of the clip member and the base portion past a certain point. As such, when the retractable clip is in the extended position and an object, such as a pants or shirt pocket for example, is positioned between the clip member and the knife, the retractable clip facilitates retention of the knife on the object by friction.

The base portion preferably further includes a serrated finger pad at one side of the peripheral edge. The finger pad is generally parallel to the guide slot and at least partially protrudes from between the two rigid plates of the knife. As such, a person's finger or fingernail may press against the finger pad to force the retractable clip to slide back and forth between the retracted and extended positions.

The base portion may further include a pair of detents that cooperate with a spring-biased protrusion of at least one of the rigid plates of the knife, such when the clip is in either the retracted or extended positions the protrusion is aligned with one of the detents to provide a tactile resistance when moving the retractable clip.

The present device is an inexpensive, easily-used retractable pocket knife clip that is sufficiently strong to withstand the rigors experienced by pocket knives, yet still will reliably hold such a knife to a belt, pants pocket, or the like. The present invention is extendible quickly into a usable, extended position, and just as easily may be collapsed into its retracted position in which the clip cannot inadvertently snag stray items. The current device fills a relatively small volume so as to allow room for folding knife blades and other knife tools. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
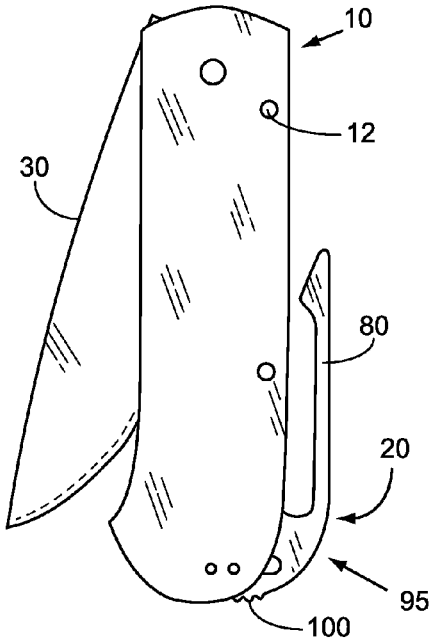
FIG. 1 is a top plan view of the invention, illustrating a clip member of the invention in an extended position.
Figure 6:
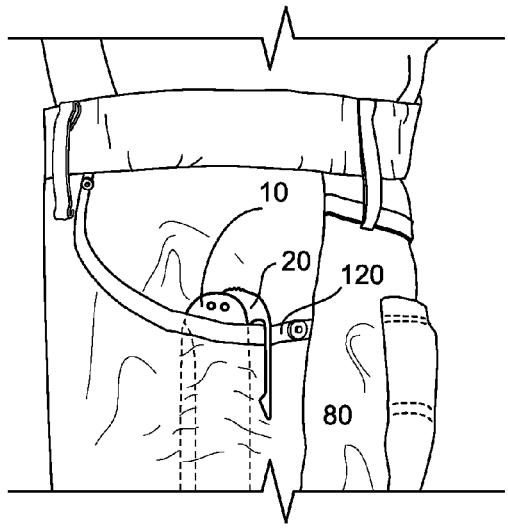
FIG. 6 is a left-side elevational view of a person carrying the knife of the present invention in a pocket, the clip member in the extended position and engaged with the pocket.
Figure 2:
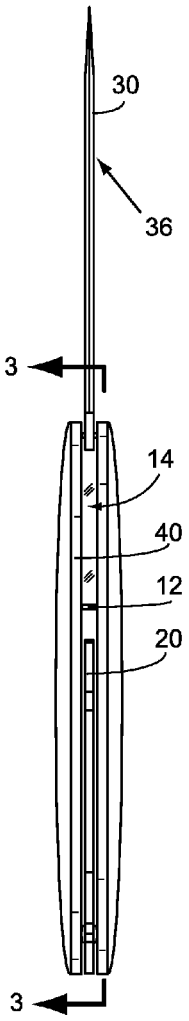
FIG. 2 is a right-side elevational view of the invention.

FIG. 1 illustrates a folding knife 10 comprising at least two rigid plates 40, each fixed generally parallel to each with a plurality of rigid spacers 12, thereby forming a space 14 between each two adjacent rigid plates 40. At least one knife blade 30 is pivotally attached between two of the at least two rigid plates 40, the knife blade 30 pivotable between a retracted position 34 (FIG. 5) and an extended position 36 (FIG. 2). The knife blade 30 and each rigid plate 40 are preferably made from a hardened steel, alloy, or other suitably rigid metallic material.

Figure 5:
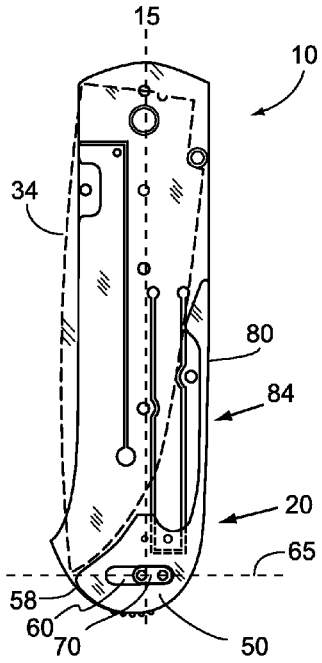
FIG. 5 is a cross-sectional view of the invention, taken generally along lines 3-3 of FIG. 2, and illustrating the clip member in the retracted position.
Figure 3:
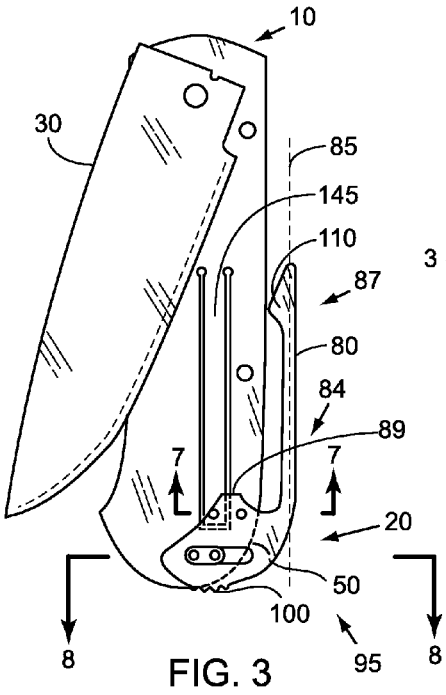
FIG. 3 is a cross-sectional view of the invention, taken generally along lines 3-3 of FIG. 2, and illustrating the clip member in the extended position.

A retractable clip 20 of the present invention includes a base portion 50 slidably fixed between two of the at least two rigid plates 40 (FIGS. 1, 3, 5). The base portion 50 includes a top surface 54, a bottom surface 56, and a peripheral edge 58 joining the top and bottom surfaces 54,56 and generally perpendicular thereto. The base portion 50 includes a generally rectangular guide slot 60 formed therethrough (FIGS. 3 and 5). The knife 20 includes a guide pin 70 fixed between the two rigid plates 40 of the knife 10 and traversing the guide slot 60 of the base portion 50. Preferably the retractable clip 20 is also made from a steel alloy, or other suitably rigid metallic material.

The retractable clip 20 further includes an elongated clip member 80 that is fixed at one end 84 to the base portion 50 (FIG. 1). The clip member 80 has a top surface 82 that is preferably coplanar with the top surface 54 of the base portion 50, and a bottom surface 86 that is generally coplanar with the bottom surface 56 of the clip member 50. A clip member peripheral edge 88 joins the top and bottom surfaces 82,86 of the clip member 80. Preferably, a long axis 65 of the guide slot 60 is generally orthogonal to a longitudinal axis 15 of the knife and a longitudinal axis 85 of the elongated clip member 80 (FIGS. 1 and 3).

Figure 4:
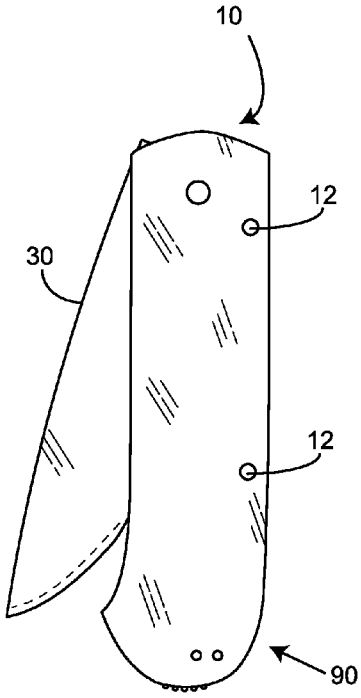
FIG. 4 is a top plan view of the invention, illustrating a clip member of the invention in a retracted position.

In use, when in a retracted position 90 (FIG. 4), the retractable clip 20 is substantially contained between the two rigid plates 40 of the knife 10 with one side 64 of the guide slot 60 contacting the guide pin 70. Alternately, in an extended position 95, the clip member 80 of the retractable clip 20 laterally extends outwardly away from between the two rigid plates 40 of the knife 10 and a second side 66 of the guide slot 60 contacts the guide pin 70 to prevent further extension of the clip member 80 and the base portion 50. Preferably the clip member 80 includes at a second end 87 thereof a retention bulb 110 projecting away from the clip member peripheral edge 88 and towards the knife 10 (FIG. 3). As such, when the retractable clip 80 is in the extended position 95 and an object 120, such as a pants or shirt pocket for example, is positioned between the clip member 80 and the knife 10, the retention bulb 110 facilitates retention of the knife 10 on the object 120 by friction.

The base portion 50 preferably further includes a serrated finger pad 100 at one side of the peripheral edge 58. The finger pad 100 is generally parallel to the guide slot 60 and at least partially protrudes from between the two rigid plates 40 of the knife 10. As such, a person's finger or fingernail (not shown) may press against the finger pad 100 to force the base portion 50 and clip member 80 to slide back and forth between the retracted and extended positions 90,95.

Figure 7:
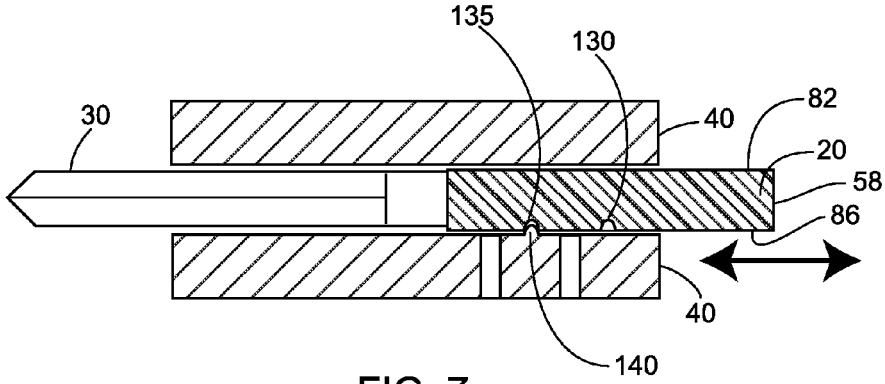
FIG. 7 is a cross-sectional view of the invention, taken generally along lines 7-7 of FIG. 3.
Figure 8:
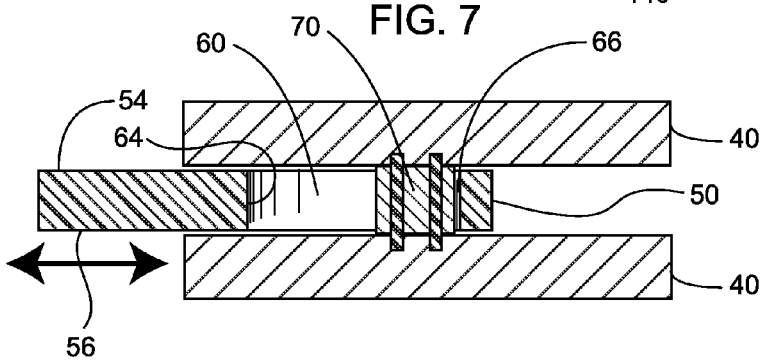
FIG. 8 is a cross-sectional view of the invention, taken generally along lines 8-8 of FIG. 3.

The base portion 50 may further include a detent 130 on the bottom surface 56 thereof. The detent 130 cooperates with a spring-biased protrusion 140 of at least one of the rigid plates 40 of the knife 10 (FIGS. 3 and 7), such when the clip 80 is in the retracted position 90 the protrusion 140 is aligned with the detent 130 to provide a tactile resistance when moving the retractable clip 20 from the retracted position 90. Similarly, a second detent 135 on the bottom surface 56 of the base portion 50 may be included that cooperates with the spring-biased protrusion 140 such that when the clip 80 is in the extended position 95, the protrusion 140 is aligned with the detent 135 to provide a tactile resistance when moving the retractable clip 20 from the extended position 95. The spring-biased protrusion 140 may be formed by cutting an elongated U-shaped section 145 in one of the rigid plates 40 (FIG. 3), for example.

The detent 130, in an alternate embodiment (not shown), may be formed in an inward surface 89 of the peripheral edge 58 of the base 50 (FIG. 3). As such, the spring-biased protrusion 140 may engage such a detent 130 along an axis orthogonal to the inward surface 89. Clearly other detent means and methods of exerting a spring bias upon them may be devised by those skilled in the art to create the desired effect of providing tactile feedback when the retractable clip 80 is moved back and forth from its retracted and extended positions 90,95.

While a particular form of the invention has been illustrated and described, it will be apparent that various modifications can be made without departing from the spirit and scope of the invention. For example, the exact placement of the detents 130,135, and the exact shape of the clip member 80 may be altered depending upon the design of the particular knife 10 into which the retractable clip 20 is to be installed. Further, the exact shape of the guide slot 60 may be a rounded rectangle as opposed to a squared-off rectangle. The scope and spirit of the present invention may extend to a knife 10 complete with the retractable clip 20, or to the retractable clip 20 by itself for incorporating into any suitable type of knife 10, folding or otherwise. Accordingly, it is not intended that the invention be limited, except as by the appended claims.

What is claimed is:

1. A folding knife, comprising:

at least one rigid member having opposing first and second longitudinal sides and first and second lateral sides; an elongated blade that pivots within a plane between a first position extending generally adjacent and substantially within the outer periphery of said rigid member and a second position extending outwardly from said rigid member, wherein the blade pivots out and away from the first lateral side; and a clip having an elongated free end and base portion, said elongated free end extends substantially parallel and substantially along the length of the lateral sides, said clip moves substantially rectilinearly within said plane between a retracted position generally adjacent said second lateral side of said rigid member and substantially within the outer periphery of said rigid member, and an extended position spaced away from said second lateral side of said rigid member, wherein the substantially rectilinear movement of said clip is substantially perpendicular to and away from the second lateral side, the elongated free end includes an unobstructed distal end when in the extended position, the base portion of the clip includes a means for guiding the substantially rectilinear movement of the elongated free end.

2. A folding knife comprising:

at least one rigid member; an elongated blade that moves within a plane between a first position extending generally adjacent said rigid member and a second position extending outwardly from said rigid member; and an elongated clip having a free end that moves substantially within said plane between a retracted position generally adjacent said rigid member and an extended position spaced away from said rigid member; said elongated clip defining at least two detents; and said rigid member having a generally U-shaped cut that defines a spring-biased protrusion configured such that upon said clip being in either said extended or retracted position, said protrusion is spring biased against one of said detents to provide a tactile resistance when said clip is moved between said extended and said retracted positions.

3. A folding knife, comprising:

at least one rigid member; an elongated blade that pivots within a plane between a first position extending generally adjacent said rigid member and a second position extending outwardly from said rigid member; and an elongated dip that moves generally rectilinearly substantially within said plane between a retracted position generally adjacent said rigid member and an extended position spaced away from said rigid member; said elongated clip defining at least two detents; and said rigid member having a generally U-shaped cut that defines a spring-biased protrusion configured such that upon said clip being in either said extended or retracted position, said protrusion is spring-biased against one of said detents to provide a tactile resistance when said clip is moved between extended and said retracted positions.

4. A folding knife, comprising:

at least one rigid member; an elongated blade that pivots within a plane between a first position extending generally adjacent said rigid member and a second position extending outwardly from said rigid member; an elongated clip that moves generally rectilinearly substantially within said plane between a retracted position generally adjacent said rigid member and an extended position spaced away from said rigid member; said elongated clip defining at least two detents; said rigid member having a generally U-shaped cut that defines a spring-biased protrusion configured such that upon said clip being in either said extended or retracted position, said protrusion is spring-biased against one of said detents to provide a tactile resistance when said clip is moved between said extended and said retracted positions; a guide pin fixed to said rigid member; and said elongated clip defining a guide slot that receives said guide pin and that is configured to permit said elongated clip to move generally rectilinearly with respect to said rigid member between said extended position and said retracted position.

* * * * *